United States Patent [19]

Knowles

[11] Patent Number: 4,548,014

[45] Date of Patent: Oct. 22, 1985

[54] METAL JOIST CONSTRUCTION

[76] Inventor: James Knowles, 1275 Club Dr., Bloomfield Hills, Mich. 48013

[21] Appl. No.: 134,984

[22] Filed: Mar. 28, 1980

[51] Int. Cl.[4] ..... E04C 3/18

[52] U.S. Cl. ..... 52/693

[58] Field of Search ..... 52/690, 691, 692, 693, 52/694, 377, 376, 639, 22; 248/317

[56] References Cited

U.S. PATENT DOCUMENTS

| | | | |
|---|---|---|---|
| 2,029,645 | 2/1936 | Waugh | 52/377 |
| 2,063,714 | 12/1936 | Waugh | 52/692 |
| 3,474,578 | 10/1969 | Wippermann | 52/694 |
| 3,748,809 | 7/1973 | Jackson | 52/693 |
| 4,077,176 | 3/1978 | Bauer | 52/692 |

*Primary Examiner*—John E. Murtagh

*Attorney, Agent, or Firm*—Harness, Dickey & Pierce

[57] ABSTRACT

A joist formed of a pair of aligned, vertically spaced apart chords interconnected by angularly arranged sheet metal webs extending between the chords. The chords are each formed of a pair of right angle cross-section metal strips, each having a horizontal leg and a vertical leg. The strips of each pair are aligned with their horizontal legs coplanar and with their vertical legs spaced apart a short distance to form a narrow vertical gap therebetween. The webs have opposite end portions which are snugly fit within the vertical gaps and are fastened to the vertical legs of the chord strips. A wood member is fastened upon at least one of the chords by positioning the wood upon the chord strips' horizontal legs and applying nails through the wood and into the gap so that the nails are frictionally locked between the vertical legs. In addition, vertically arranged wood strips interconnect the chords at the opposite ends of the joist.

9 Claims, 10 Drawing Figures

METAL JOIST CONSTRUCTION

BACKGROUND OF THE INVENTION

This invention relates to a truss construction useful as roof or floor joist supports in building constructions. The type of truss involved is formed of metal chords interconnected by metal webs to provide a prefabricated, elongated truss.

Trusses formed of metal chords and metal interconnecting webs are known. However, available devices are relatively expensive and are difficult and expensive to fabricate. Hence, trusses made out of a combination of wood chords with metal connector webs have been developed in an effort to reduce costs and provide necessary strengths. Examples of this kind of construction are illustrated in my prior U.S. Pat. No. 4,002,116, issued Jan. 11, 1977, and entitled "Apparatus for Forming Trusses" and also in my prior U.S. Pat. No. 4,078,352, issued Mar. 14, 1978, and entitled "Truss-Web Connector".

In my prior patents, the chords are formed of elongated wood strips which are interconnected by preformed sheet metal webs whose opposite ends overlap the sides of the chords and are fastened thereto by means of struck-out teeth embedded into the wood. Preferably, the webs are formed in V-shaped groups of two which provide a zig-zag interconnection along the length of the truss. With that kind of truss, the connector plates are arranged to overlap the wood chords. That is, their toothed connector portions overlap the wood and by means of a suitable apparatus, such as that illustrated in my U.S. Pat. No. 4,002,116, mentioned above, the connectors are forced into interlocking engagement with the wood chords.

The foregoing type of truss and method of fabricating and equipment produce an economical, highly satisfactory, strong truss for use as a joist. However, for certain purposes, it is desirable to use a metal chord construction, particularly in view of the growing unavailability and rising costs of good lumber from which the chords may be made. Thus, the invention herein is concerned with producing a good, inexpensive, truss or joist utilizing metal chords so as to avoid the necessity of using expensive, high quality chord lumber, but still including some wood chord parts.

SUMMARY OF THE INVENTION

The invention herein contemplates forming each of the truss chords out of a pair of spaced apart, aligned, right angle shaped metal strips. One leg of each strip is horizontally aligned with the corresponding leg of the other strip. The other legs of the pair of metal strips are vertically aligned, but spaced apart a short distance to form a narrow gap therebetween. The webs, which interconnect the chords, each have a flat end portion fitted within their adjacent gaps and spot welded to the metal strip vertical legs. A low quality, inexpensive, wood strip may be positioned upon the horizontal legs of at least one of the chords and fastened thereto by nails extending into and frictionally locked within the gap.

One object of the invention herein is to permit the construction of metal trusses which are of a greater length than normally possible with comparable wood chord constructions, but which incorporate the advantages of wood chords with respect to providing wood fastening edges against which other building components can be nailed.

The truss construction herein, readily lends itself to producing joists of varying heights and lengths, as for example, on the order of a 6 inch to a 16 inch height and up to 24 to 32 feet in length, using commercially available metal "angle iron" strips or rolled angle strips, relatively inexpensive sheet metal web constructions, and inexpensive low grade wood. Of course, the dimensions may vary considerably, depending upon the design requirements, but it can be seen that the length dimensions can be increased as compared with similar wood chord truss assemblies. Significantly, the vertical depth or height of the truss, constructed in accordance with the invention herein, can be substantially reduced as compared to a similar wood chord truss to thereby reduce overall building costs.

These and further objects and advantages of this invention will become apparent upon reading the following description, of which the attached drawings form a part.

DETAILED DESCRIPTION

Figure 1:
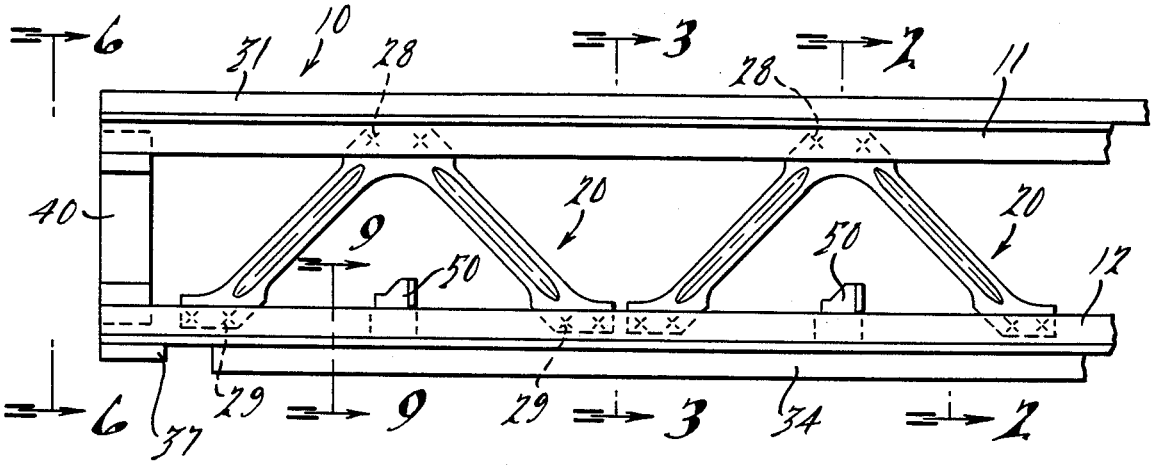
FIG. 1 is an elevational view of the truss or joist construction, illustrating one end of the truss.
Figure 2:
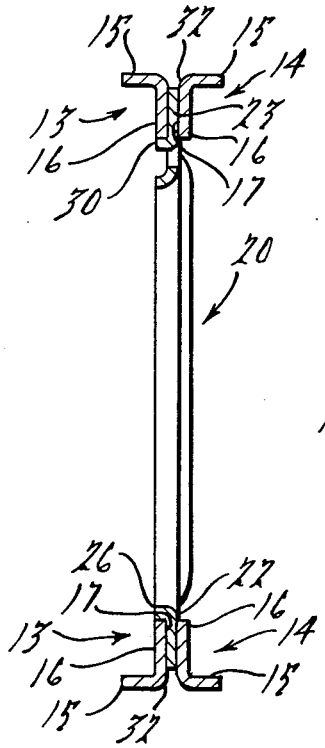
FIG. 2 is an enlarged cross-sectional view taken in the direction of arrows 2—2 of FIG. 1.

FIGS. 1-5 depict the preferred form of the invention. As shown in FIGS. 1 and 2, the joist 10 is formed with an upper chord 11 and a lower chord 12, each of which is made of a pair of angle iron strips 13 and 14. The right angle cross section strips 13 and 14 are arranged with a horizontal leg 15 and a vertical leg 16, with the horizontal legs of each pair of strips in alignment and the vertical legs spaced apart a short distance to provide a space or gap 17 between the strips.

Figure 4:
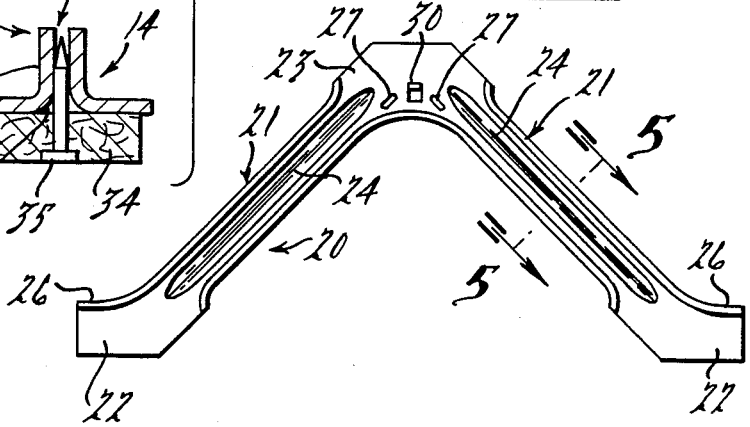
FIG. 4 is an enlarged elevational view of the V-shaped connector, per se.

The upper and lower chords are interconnected by sheet metal connectors 20 (shown individually in FIG. 4). Preferably, the connectors are V-shaped stamped sheet metal structures with two diagonally extending legs or webs 21. The lower ends of each web are provided with flat, enlarged end portions 22 and the other ends of the webs are joined at a common, junction portion 23 which also is flat.

Figure 5:
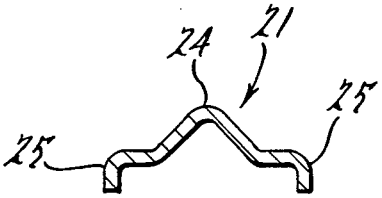
FIG. 5 is an enlarged cross-sectional view taken in the direction of arrows 5—5 of FIG. 4.

The webs are each preferably formed with an elongated stamped rib 24 extending its length, as shown in FIGS. 4 and 5. In addition, the side edges of each web are turned into side flanges 25 which are extended along the upper edges of the end portions 22 to form short, straight, horizontal stop flanges 26. Additional shorter stamped ribs 27 may be formed in the flat common portion 23 for rigidification. The ribs and side flanges serve to rigidify or stiffen the sheet metal parts and also to better transmit loads and resist twisting due to tortion type loads.

As illustrated in FIGS. 1 and 2, the end flat portions 22 are snugly inserted into the space or gap 17 between the vertical legs 16, 16 of the lower chord. Likewise, the flat, common junction portion 23 of each connector is inserted snugly into the space between the vertical legs 16, 16 of the upper chord. Spot welds 28 along the upper chord 11 and spot welds 29 along the lower chord 12 fasten the end portions 22 and junction portions 23 of each of the connectors 20 to the vertical legs 16 of each of the metal strips which make up the two chords.

The flat end portions 22 are properly positioned between the adjacent vertical chord legs by means of the stop flanges 26 which are formed on the upper edges of the end portions 22. Similarly, the common, junction portions 23 are properly positioned between adjacent vertical chord legs by means of a struck-out stop portion 30, which abuts the lower edge of its adjacent chord leg.

Figure 3:
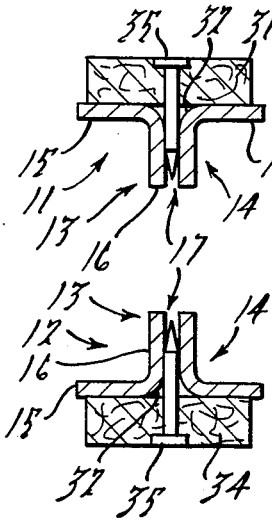
FIG. 3 is an enlarged cross-sectional view taken in the direction of arrows 3—3 of FIG. 1.

An upper, wood chord member 31 is placed upon, in face to face contact with, the horizontal legs 15, 15 of the upper chord strips (FIGS. 1 and 3). Such wood member may be in the form of an inexpensive grade 2×4 or other similar types of wood strips. The wood member 31 is fastened to the upper chord 11 by means of nails 35 which penetrate through the wood and extend into the gap or space 17 between the vertical strip members. The corners 32 of the angle iron strips are rounded to guide the nails into the space 17. The spacing 17 between the two vertical legs 16, 16 is less than the diameter of the nail so that the nail is jammed or frictionally squeezed within the space for holding. Thus, the space which is produced by the thickness of the flat portions of the connectors serves the function of receiving the oversized diameter nail which is thus locked into the space.

A lower wood chord member 34 may also be used and also fastened in place by means of nails 35 extending into the space or gap between the vertical legs of the two strips that make up the lower chord 12. The lower wood chord member may be of a different size in cross sections and/or a different length than the upper wood chord member 31. The wood members of the upper and lower chords act as nailing pads or surfaces upon which other building material can be rested and secured. For example, roof decking material or panels can be secured to either the upper or lower wood chord members. In addition, the wood chord members also provide some stiffening or strengthening of the chord. The method of fastening the wood chord members to the metal chords, i.e., the nails arranged in the gaps, permits some relative movement between the parts in response to temperature changes, flexing under load, etc.

Figure 6:
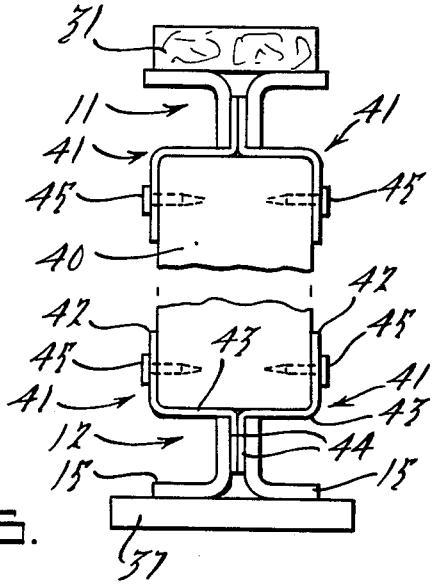
FIG. 6 is an enlarged end view of the truss taken in the direction of arrows 6—6 of FIG. 1.
Figure 7:
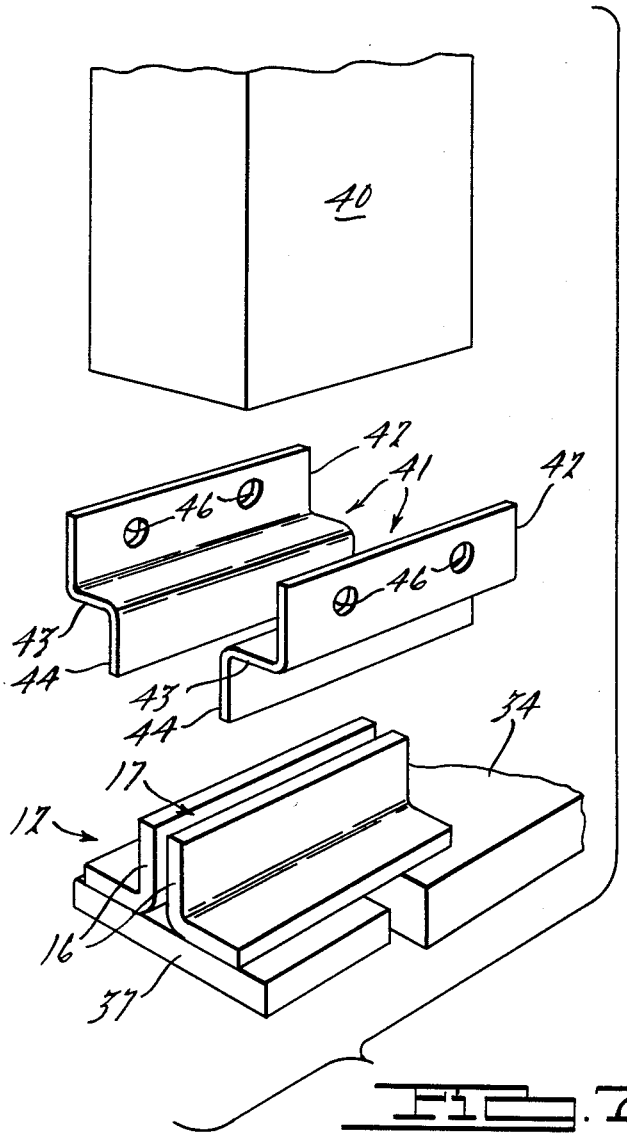
FIG. 7 is a disassembled, perspective view of a lower portion of a wood end connector and a portion of the lower chord with a bracket for fastening the portions together.

FIGS. 1, 6 and 7 illustrate the use of a metal end plate 37 welded to the horizontally arranged legs 15, 15 of the lower chord 12. The plate 37 serves as a bearing plate for resting the truss upon a vertical column or wall. Thus, the metal end plate may be of a size to fit upon the support and the lower wood chord member 34 is forshortened to allow room for the metal plate.

The joist or truss 10 may be provided with opposite end connector members 40 formed of a straight wood piece extending between the upper and lower chords (only one end connector member is shown in FIG. 1). This member 40 may be made of a common 2×4 or of a thicker piece. The opposite ends of the member 40 are fastened to the chords 11 and 12 by means of brackets 41 (FIGS. 6 and 7). Such brackets comprise a pair of metal pieces bent into an outer flange 42, a central portion 43 and an inner flange 44. The inner flanges 44 of two brackets 41 are inserted and positioned within the gap 17 between the vertical legs 16, 16 of each of the upper and lower chords 11 and 12 and the brackets are then spot welded to the chords to hold them permanently in place. Nails 45, extending through holes 46 formed in the outer flanges 42 secure the brackets to the connector members 40.

Figure 10:
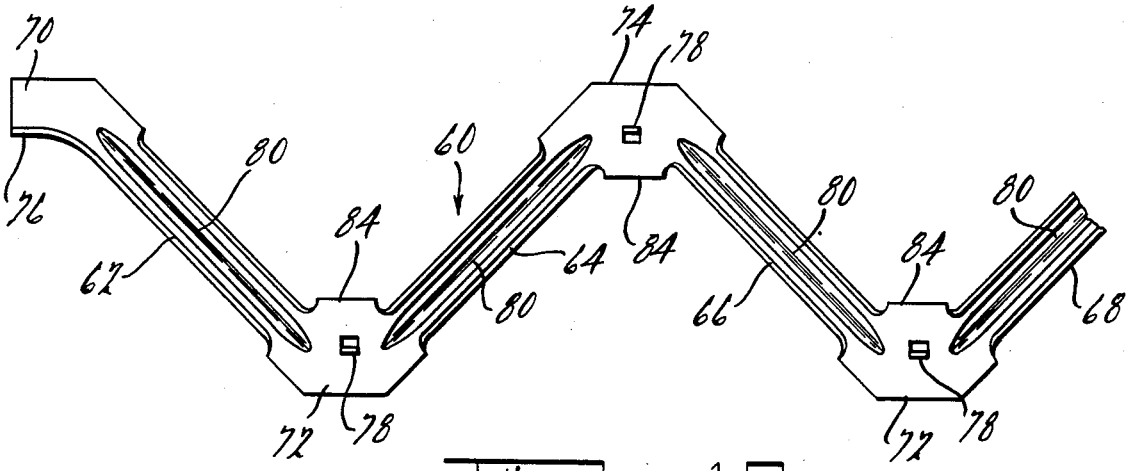
FIG. 10 illustrates another embodiment of the connector member.

In another embodiment of the invention, the sheet metal connectors may be formed of a W-shaped configuration, as illustrated in FIG. 10. These connectors 60 are similar to the connectors 20 described above and are used in the same manner. For a long joist or truss, fewer W-shaped connectors 60 would be needed than if V-shaped connectors were utilized.

The connectors 60 have four diagonally extending legs or webs 62, 64, 66 and 68. The end webs 62 and 68 have flat, enlarged end portions 70 at their outer, unconnected ends. The other ends of webs 62 and 68 are connected by flat junction portions 72 with one end of webs 64 and 66, respectively. The remaining ends of webs 64 and 66 are joined at a common, junction portion 74, which also is flat. The flat end portions 70, 72 and 74 are adapted to be snugly inserted and spot welded into the space 17 formed between the angle iron strips 13 and 14 of the upper and lower chords 11 and 12, similar to the manner above described with reference to FIGS. 1–4.

The flat end portions 70 are properly positioned between adjacent vertical chord legs by means of horizontal stop flanges 76 formed on the upper edges of the end portions. (The flanges 76 correspond to the stop flanges 26 described above). The flanges 76 are continuations of the side edges of each of the webs which are turned inwardly to form side flanges 82. The common juncture portions 72 and 74 are positioned in place between adjacent vertical chord legs by means of struck-out stop portions 78 (similar to stop portions 30). The webs 62, 64, 66 and 68 also preferably have elongated reinforcing ribs 80 thereon.

Although the side flanges 82 could extend along the full lengths of each of the legs or webs and thus continue around the edge of the common juncture portions, it is also possible to straighten out or flatten the flanges at the common juncture points. These flattened flanges 84 are shown in FIG. 10.

The constructions described above permit the use of a longer truss than that which otherwise could be made with wood construction for a given depth and, in view of the reduced availability of high quality wood, coupled with the higher prices of lumber, provides a relatively lower cost, better truss which can be assembled fairly easily with consistently high quality. Nevertheless, the truss retains a number of the advantages of a wood truss, that is providing nailing surfaces which surface is also better conformed to applied panels or the like.

Because of the space or gap between adjacent metal angle iron strips which make up each of the chords, a system is provided for mounting other parts to the truss in a simple and inexpensive manner. For example, metal chips or brackets might be needed for the purposes of spacing apart adjacent trusses which might make up a roof or floor construction. If a clip or a row of clips is attached to each adjacent truss, the clips may be interconnected by rods for spacing and rigidifying the lower ends of the trusses.

Figure 8:
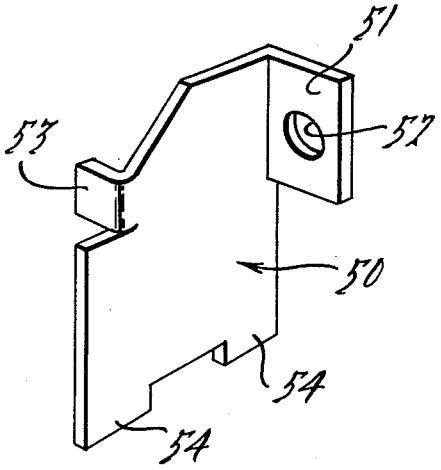
FIG. 8 is a perspective view of a clip used with the truss.
Figure 9:
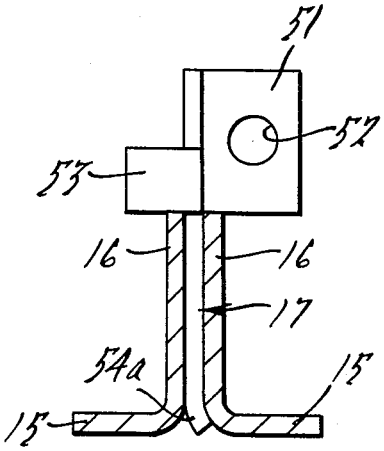
FIG. 9 is an enlarged cross-sectional view showing the clip mounted upon a chord, and taken in the direction of arrows 9—9 of FIG. 1.

One form of a mounting clip which may be used for this purpose is shown in FIGS. 8 and 9. The clip 50 is made of a flat piece of sheet metal having an ear or flange 51 bent out at its upper end. A hole 52 is provided for receiving the end of a rod or a bolt-like fastener. The opposite side of the plate or clip 50 is bent out a short distance to provide a short flange 53 which acts as a stop to abut against the upper edge of the metal strip 16 which makes up the chord.

The lower end of the flat plate or clip may be formed as a pair of legs 54, one or both of which may be bent into hook-shapes 54*a* to secure the clip in place.

The clip 50 is inserted into the space 17 between adjacent vertical legs 16, 16 until its flanges 51 and 53 abut the upper ends of the vertical strip against which it is rested. Then the legs 54 may be bent horizontally to lock the clip in place (forming 54*a*). In that manner, the clip may be simply applied without the need for additional fasteners. The clip 50 may also be used for other purposes, as for example, applied upside down upon the lower chord in places where the wood chord member has been omitted, for fastening various objects to the lower edge of the lower chord.

While it will be apparent that the preferred embodiments of the invention disclosed are well calculated to fulfill the objects above stated, it will be appreciated that the invention is susceptible to modification, variation and change without departing from the proper scope or fair meaning of the invention.

What is claimed is:

1. A truss formed of a pair of aligned, spaced apart chords interconnected by sheet metal webs, the improvement comprising, said chords each being formed of a pair of elongated right angled-shaped in cross-section metal strips, said strips having parallel, slightly spaced apart vertical legs which form a narrow gap between the strips, and horizontally aligned, oppositely extending horizontal legs, said webs each being provided with flattened, opposite end portions snugly arranged within their adjacent gaps and in face-to-face contact with the aligned vertical legs of their respective chords and being fastened to such vertical legs, a first wood member positioned upon the horizontally aligned legs of at least one of the chords and being elongated and being fastened to said chord by nails extending through the wood member and into the gap between the adjacent strip vertical legs of that chord, with the nails being of a diameter for frictionally locking within the gap against their adjacent vertical leg portions, at least one second wood member, said second wood member positioned at an end of the truss and extending substantially perpendicular between the adjacent chords, and securing means securing the opposite ends of said second wood member to its adjacent chord end, said means comprising U-shaped holders having flanges thereon, said holder holding the opposite ends of said second wood members, and said flange being fitted within the gap between the vertical legs of the chords.

2. A construction as defined in claim 1 wherein said securing means comprises a pair of adjacent plate-like members and said flanges comprise bent end portions of said plate-like members which as a pair are fitted within said gap between the vertical legs of the chords, and having opposite end portions bent into spaced apart outer flanges forming said U-shaped holders.

3. A truss formed of a pair of aligned, spaced apart chords interconnected by sheet metal webs, and improvement comprising, said chords each being formed of a pair of elongated right angle-shaped in cross-section metal strips, said strips having parallel, slightly spaced apart vertical legs which form a narrow gap between the strips, and horizontally aligned, oppositely extending horizontal legs, said webs each being provided with flattened, opposite end portions snugly arranged within their adjacent gaps and in face to face contact with the aligned vertical legs of their respective chords and being fastened to such vertical legs, an elongated wood member positioned upon the horizontally aligned legs of at least one of the chords and being fastened thereto by nails extending through the wood member and into the gap between the adjacent strip vertical legs of that chord, with the nails being of a diameter for frictionally locking within the gap against their adjacent vertical leg portions, and at least one sheet metal bracket, said bracket having a vertical base portion inserted within the gap between the adjacent strip vertical legs of one of the chords, and an extension portion, extending transversely of said chord, for providing an attachment point on the chord.

4. A construction as defined in claim 3, and including a transversely bent stop portion formed on one horizontal edge of the vertical base portion for abutting the free edge of an adjacent vertical leg, and with a bendable extension portion formed upon the opposite edge of the base portion for abutting the horizontal leg of the chord for thereby locking the bracket base portion to the chord.

5. In a truss formed of a pair of aligned, spaced apart chords interconnected by sheet metal webs, the improvement comprising, said chords each being formed of a pair of elongated right angle-shaped in cross-section metal strips, said strips having parallel, slightly spaced apart vertical legs which form a narrow gap between the strips, and horizontally aligned, oppositely extending horizontal legs, said webs each being provided with flattened, opposite end portions snugly arranged within their adjacent gaps and in face-to-face contact with the aligned vertical legs of their respective chords and being fastened to such vertical legs, stop members on said opposite end portions of said webs for positioning said webs properly in said gaps, and an elongated wood member positioned upon the horizontally aligned legs of at least one of the chords and being fastened thereto by nails extending through the wood member and into the gap between the adjacent strip vertical legs of that chord, with the nails being of a diameter for frictionally locking within the gap against their adjacent vertical leg portions.

6. A construction as defined in claim 5 and said wood member being positioned upon the upper surface of the upper chord, for forming a nailing surface upon the upper longitudinal edge of the truss.

7. A construction as defined in claim 5 and said wood member being fastened to the upper metal chord, and including a second elongated wood member arranged face-to-face contact with the horizontally aligned strip legs of the lower metal chord at least along the center portions of the truss, and being fastened thereto by nails extending within and frictionally secured within the gap between the vertical legs of the lower chord.

8. A construction as defined in claim 5, and including a wood member, at each end of the truss, extending substantially perpendicular between the adjacent chords and means securing the opposite ends of said wood members to its adjacent chord end.

9. A construction as defined in claim 5, and including at least one sheet metal bracket having a vertical base portion inserted within the gap between the adjacent strip vertical legs of one of the chords, and an extension portion, extending transversely of said chord, for providing an attachment point on the chords.

* * * * *